US008931427B2

(12) United States Patent
Mueller

(10) Patent No.: US 8,931,427 B2
(45) Date of Patent: Jan. 13, 2015

(54) SAFETY TENDER LIFT

(76) Inventor: Peter A. Mueller, Gattikon (CH)

( * ) Notice: Subject to any disclaimer, the term of this patent is extended or adjusted under 35 U.S.C. 154(b) by 0 days.

(21) Appl. No.: 13/261,347

(22) PCT Filed: Jan. 13, 2010

(86) PCT No.: PCT/CH2010/000008

§ 371 (c)(1),
(2), (4) Date: Nov. 5, 2012

(87) PCT Pub. No.: WO2011/085503

PCT Pub. Date: Jul. 21, 2011

(65) Prior Publication Data

US 2013/0055945 A1 Mar. 7, 2013

(51) Int. Cl.

| | |
|---|---|
| ***B63B 23/00*** | (2006.01) |
| ***B63B 23/32*** | (2006.01) |
| ***B63B 27/36*** | (2006.01) |

(52) U.S. Cl.

CPC ..... *B63B 23/32* (2013.01); *B63B 27/36* (2013.01)

USPC ..... 114/365; 114/366; 114/259

(58) Field of Classification Search

USPC ..... 114/259, 366, 365

See application file for complete search history.

(56) References Cited

U.S. PATENT DOCUMENTS

| | | | | | |
|---|---|---|---|---|---|
| 4,157,596 | A * | 6/1979 | Green | 114/365 |
| 4,627,377 | A * | 12/1986 | Zoonens | 114/373 |
| 4,878,450 | A * | 11/1989 | Schmidt, Jr. | 114/259 |
| 5,170,742 | A * | 12/1992 | Roskelley | 114/366 |
| 5,193,479 | A * | 3/1993 | Bielefeld | 114/366 |
| 5,483,912 | A * | 1/1996 | Thomas | 114/259 |
| 5,979,861 | A * | 11/1999 | Weaver | 248/642 |
| 6,038,994 | A * | 3/2000 | Ford et al. | 114/259 |
| 6,095,080 | A * | 8/2000 | Weber | 114/370 |
| 6,321,678 | B1 * | 11/2001 | Skulnick | 114/381 |
| 6,327,992 | B1 * | 12/2001 | Martin | 114/259 |
| 6,474,256 | B1 * | 11/2002 | Vogel | 114/368 |
| 6,591,770 | B1 * | 7/2003 | Blackmore | 114/48 |
| 6,782,842 | B1 * | 8/2004 | Alvord | 114/369 |
| 6,786,170 | B2 * | 9/2004 | Trowbridge | 114/259 |
| 6,953,003 | B1 * | 10/2005 | Mulhern | 114/259 |
| 7,293,521 | B1 * | 11/2007 | Johns et al. | 114/259 |
| 2008/0105186 | A1 * | 5/2008 | Johns et al. | 114/259 |
| 2013/0055945 | A1 * | 3/2013 | Mueller | 114/259 |

FOREIGN PATENT DOCUMENTS

| | | | | |
|---|---|---|---|---|
| DE | 1 962 5155 | A1 | 1/1998 | |
| DE | 1 996 3057 | C1 | 12/2000 | |
| EP | 0 153 248 | | 8/1985 | |
| GB | 2 319 014 | A | 5/1998 | |
| WO | WO 96/37403 | A1 | 11/1996 | |
| WO | WO 2008/022 421 | A1 | 3/2004 | |
| WO | WO 2004022421 | A1 * | 3/2004 | B63B 23/06 |
| WO | WO 2008/098 393 | A1 | 8/2008 | |

* cited by examiner

*Primary Examiner* — Lars A Olson
*Assistant Examiner* — Jovon Hayes
(74) *Attorney, Agent, or Firm* — Oliff PLC

(57) ABSTRACT

The invention comprises a tender pick up (1) having the appropriately formed retainer (4) hinged on a chock (2). The retainer (4) is manually or by means of cylinder (5) and spring (6) preloaded and slip-free, and clamps a tender (22) with docking mean (29). If necessary, the use of sensors (30) register the exact position, before the appropriate functions are activated by the controller (19). Is a drop down stair (8) or a platform (80) or a deck (51) fixed onto the transom (20) of the watercraft, then by using the swiveling arms (7) the tender (22) is tilted out when lowering or extended by a sledge (81). The weight of the platform (80) or stair (8) and the tender pick up (1) can be compensated by means of the static lifting force of the lifting body (14). To bring up the platform (80) or stair (8) safely, a gas spring (37) can be used as a supportive measure.

12 Claims, 3 Drawing Sheets

SAFETY TENDER LIFT

This application claims priority of PCT application PCT/CH2010/000008 having a priority date of Jan. 13, 2010, the disclosure of which is incorporated herein by reference.

TECHNICAL FIELD

The invention is based on the pick-up and fastening of a tender on a platform at the transom of a watercraft, so that the positioning and fixation on the platform takes place quickly and safely by means of simple technical mean and is designed in such a way that launching or tender pick-up can also take place in an automatic and controlled way.

BACKGROUND OF THE INVENTION

Height adjustable carrier mean are being used more and more to pick-up and fix tender boats, as described in U.S. Pat. No. 6,095,080, U.S. Pat. No. 4,157,596, GB 2319014, DE 19963057 C1, or WO 96/37403 whereby it deals with various lifting techniques and pick-up devices for the tenders. The exact positioning on the platform as well as the fixation of a tender is still the work of the crew.

SUMMARY OF THE INVENTION

The invention involves that a tender, which can also be a jetski or a similar craft, is placed on a platform or a drop down stair, which is fixed at the transom of a watercraft, can be positioned quickly, easily and fixed safely at the required position, and that the tender is released again simply and in an uncomplicated way by means of manual or electronic mean.

It is really not easy to pick-up a tender in light choppy or windy seas as the yacht has another rolling and pitching frequency compared to a small tender, respectively both crafts have different drifting levels. Therefore mean are available so that the driver of the tender can aim at the lifting platform or the swiveling arms in the case of a stair configuration easily and can drive in unerringly and is stopped automatically at the appropriate place. The driver has only then to activate the locking mechanism, which can be accomplished by a remote control or effectuated automatically, which releases at the same time the signal to lift the platform, as the tender has already been brought into position automatically and secured by appropriate mean. The underlying platform or swivel arm configuration can then be elevated, respectively retracted. With this mean the tender can be fastened and parked lengthwise or crosswise on the transom or also on the deck or in the garage of the watercraft. The positioning, the holding and finally the locking of the tender to the lift is accomplished without the assistance of third parties. In this respect it adds to the safety as persons standing and working to turn and strap down the tender on the mostly wet lifting platform, are at risk, especially on leisure yachts which often do not have a professional crew on board.

Core of the invention is an easy to operate, quick and unerring tender pick up with simple fastening of a tender without rope and girths and to bring it onto a lift or stair and without the assistance of third parties.

BRIEF DESCRIPTION OF THE DRAWINGS

Various exemplary aspects of the invention will be described with reference to the drawings, wherein. Similar elements are named in the various figures with the same references.

A schematic side view of a tender pick up with tiltable retainer on a horizontal swiveling arm which is fixed on a dropdown stair and lying underneath a lifting body with a wing and on the tender pick up is a tender

FIG. 2

A schematic overhead view of a tender and a tender pick with tiltable retainer and the docking mean fixed on the tender with positioning sensors fixed under it and at the retainer

FIG. 3

A schematic overhead view of a tender pick up with the horizontal swiveling arms which are driven by the motor driven drive belts enabling at the same time to maintain the direction of the tender

FIG. 4

A schematic side view of a tender pick up with tiltable retainer on a horizontal swiveling arm which is fixed on a dropdown stair and having a lifting body and a gas spring underneath

FIG. 5

A schematic side view of a tender pick up with tiltable retainer fixed on a dropdown platform and guiding bars next to the tender.

FIG. 6

Shows a schematic side view of a tender pick up with a hinged, manually forward tilting holding mean, which is operated mechanically.

Only essential elements of the invention are schematically shown to facilitate immediate understanding.

DETAILED DESCRIPTION OF THE PREFERRED EMBODIMENTS

Figure 1:
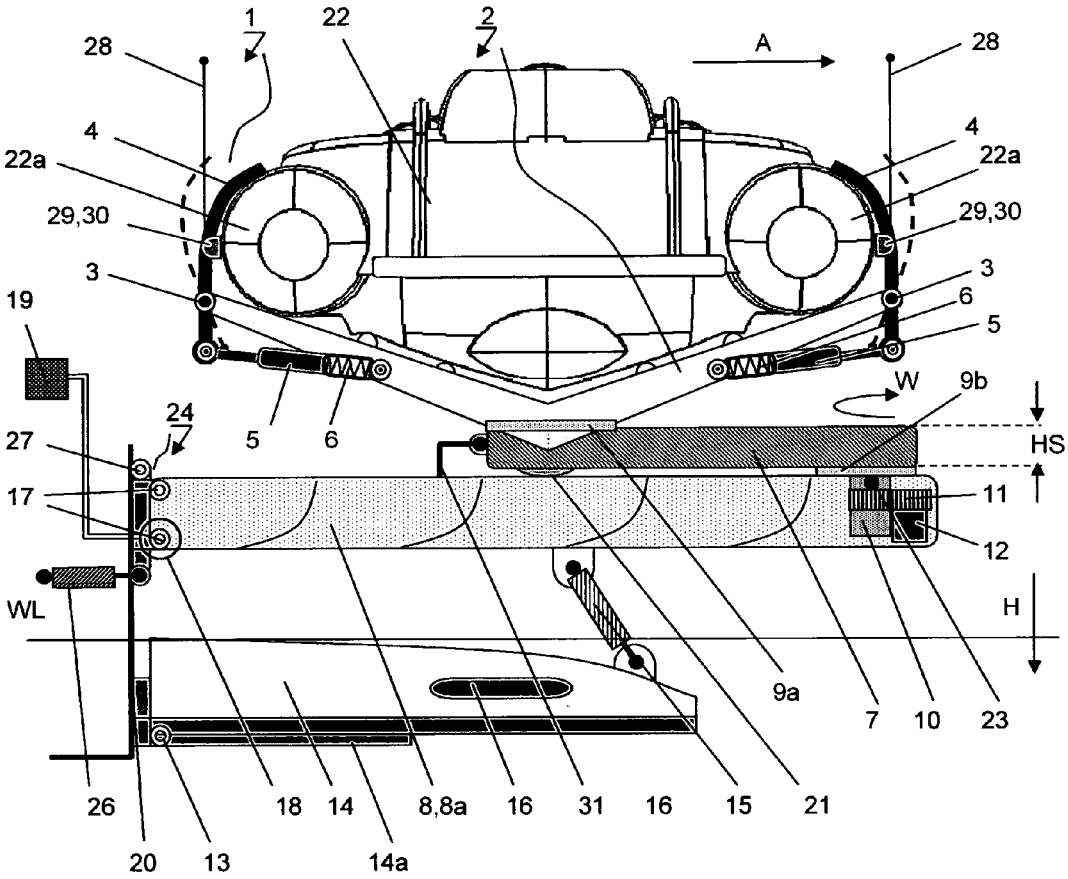
FIG. 1

FIG. 1 shows a schematic side view of a tender pick up 1 consisting of a chock 2, on which a tiltable retainer 4 is fixed on a pivot mechanism 3 and a cylinder 5 with a spring 6 triggers a folding movement. The chock 2 is fixed on a horizontal swiveling arm 7 which is fixed on, for example a drop down stair 8. The swiveling arm 7 has an upper swiveling bearing 9*a* and a lower swiveling bearing 9*b* and the swiveling arm 7 is operated by a swiveling motor 12 by means of a turning axis 10 stored in the stair 8 and on this is placed a gear set 11 or a rod or a V-belt. Under the stair 8, on each side of the transom 20, lifting bodies 14 are fixed on the lifting body bearings 13, which are connected to the stair 8 by telescopic connectors 15. Under the stair 8 or between the lifting body 14 is a wing 16. The stair 8 can be swiveled by means of a bearing set 17 over the stroke H to under the waterline WL by means of lowering mean and lowering lever not shown here and on bearing set 17 a travel sensor 18 is fixed to record the lowering angle and the travel sensor 18 is connected to the controller 19. The stair 8 is advantageously fixed on the transom 20 and can also be a platform 80 with the appropriate lowering lever and mean. The swiveling arms 7 have supports 21, as for example wheels, so that the swiveling arms 7 do not constantly need to hold the weight of the tender 22 free floating, especially in heavy seas. On a swiveling arm 7 or on another suitable place is a position sensor 23 which gives information on the position of the swiveling arms 7. In the position shown here, the position sensor 23 gives information to the controller 19, that the stair 8 cannot be lowered in the arrow direction H. Only by a certain swiveling angle value, according to arrow W, can the stair 8 be lowered, as with this precautionary measure the tender 22, respectively the swiveling arm 7 has been extended rearwards, according to arrow A, and can therefore not collide with the stair 8.

Before the swiveling arms 7 are deflected, the stair 8 can be lifted up by a stroke level HS so that the stair 8 is raised upwards and the support 21, at the same time a twist locking device, prevents the support 21 coming into contact with stair steps 8*a* and thus can swivel freely.

Is the tender 22 in the water and should be picked up, then first of all the swiveling arms 7 are extended in arrow direction A, then the stair 8 is lowered down to under the waterline WL. The stair 8 has stair steps 8*a* which stay horizontal by means of the parallel swiveling arms not shown here, so that the swiveling arm 7 also stays horizontal. The stair steps 8*a* are open so that water can flow into the interior of each of the stair steps 8*a*, exception are the areas of the turning axis 10, gear set 11 and swiveling motor 12. Thereby it is prevented that the stair steps 8*a* turn into a lifting body and that the transom 20 of the watercraft is lifted up. When lowering the stair 8, it is even desirable that the watercraft gains depth in the transom area so that the stair 8 does not have to be lowered as much. The stair steps 8*a* are kept as much as possible in the horizontal position by using a step compensator 24. This consists of a plate 25, which can be swiveled around the trim hinge 27 by using a trim cylinder 26. Or the stair steps 8*a* can be pushed directly into the horizontal direction by the trim cylinder 26, for example which acts on the bearing set 17. In this way the stair is kept in balance, respectively the swiveling arms 7 are kept in the best possible horizontal position. Also in heavy seas for example, a stable horizontal position of the stair 8 is guaranteed, by means of the controller 19, a tilting sensor and an algorithm of the trim cylinder's 26 stroke operation.

The lifting bodies 14 have the function of compensating the outboard weight of the stair 8, the tender pick up 1 and possibly parts of the tender 22, so that the watercraft even with this additional weight outside the hull, will stay well-trimmed. Furthermore the lifting bodies 14 are slanted by means of the lifting body bearing 13, for example to the deadrise of the watercraft. Thereby when lowering the stair 8 with the connector 15 between stair 8 and lifting body 14, the lifting body 14 is swiveled outwards resulting in an additional stabilization of the watercraft. Depending on the deadrise the total width of a watercraft at the transom area can gain width easily around 15%. Of course the lifting bodies 14 create a dynamic lift without the annoying current drag on the grounds of the steps 14*a* which are fixed under the lifting bodies 14 and the steps act as a stalling mean. In the case of watercraft with high transom loads or catamarans, an appropriate wing 16 can be fixed behind the watercraft transom, on the platform 80 or stair 8, but not under the hull. This wing 16 creates an additional dynamic lift and can be rigid or movable to the current flow. Such a wing 16 can also be fixed to the lifting bodies 14 whereby close attention must be given to the fixation kinematic due to the lateral extension of the lifting bodies 14 when lowering the platform 80 or stair 8. Such a wing 16 is of use above all in the start phase or can reduce the purposing of the bow whilst cruising.

If the tender 22 drives between the retainers 4 of the lowered stair 8, then the bearing poles 28 help finding the entrance. If required, these can be folded away or lowered. On the outside of its hull the tender 22 has in addition docking mean 29 which ultimately serves to lock the tender 22 together with the retainer 4. The bow side retainers 4 are either placed so that the tender 22 gets stopped from travelling further due to the cone shaped bow, or the docking mean 29 are so protruding at the rear that the tender 22 can be stopped by the transom side retainers 4. Inductive sensors 30 on the lower side of the tender 22 or in the retainer 4 enable the stair 8 to be lifted up if the sensors emit positive signals based on the correct position of the tender 22 in relation to the retainer 4 and thus the tender 22 rests on the chock 2. Thereafter the retainer 4 is closed so that the tender 22 cannot be lifted-up from the chock 2 and possibly slip out of position in heavy seas, whilst at the same time the stair 8 is being raised up further and the swiveling arms 7 are synchronously, monitored and appropriately locked in by the position sensors 23, so that these do not collide with the steps 8*a*. The cylinders 5 are lockable or are self-locking and have a spring 6 so that the retainer 4 always press with a preloaded force against the tender 22. This is to be recommended in the case of tenders with an inflatable tube, as these breathe in accordance with the daily temperature fluctuations: on a warm day the tube stretches, on a cold night it contracts. The spring 6 thereby ideally compensates the diameter of the tube. The pivot mechanism 3 can be designed in such a way so that, for example by using a rocker, the curved retainer 4 holds down the upper side of the tender 22 tube. The cylinder 5 can also be fixed radially directly onto the pivot mechanism 3 and achieve a preload with a torsion spring element.

The controller 19 ensures other functions, as for example that whenever the gear or motor are running then the stair 8 cannot be lowered but that the lifting up mode is always possible. Furthermore that the tender 22 can only be tilted out when the stair 8 is up, respectively that no collision between swiveling arm 7 and stair step 8*a* can take place. Or that the stair 8 can be only be lowered on the condition that, the retainers 4 are open, otherwise there is the risk that the tender 22 will be drawn down underwater. Or, in conjunction with a remote control, the engine of the tender 22 is stopped, so that it cannot run without cooling water and thus overheating, based on the information from the travel sensor 18 regarding the appropriate position of the stairs.

Of course the functions can also be executed manually but a pushbutton—not shown and described here—is not particularly practical in heavy seas. Instead of inductive sensors 30, light sensors, pressure sensors and other support mean can be implemented to detect the position.

In addition at least one swiveling arm 7 has an additional lock 31, which can also be integrated directly in the support 21 so that when the watercraft is travelling the swiveling arms 7 are locked in the best possible way.

Figure 2:
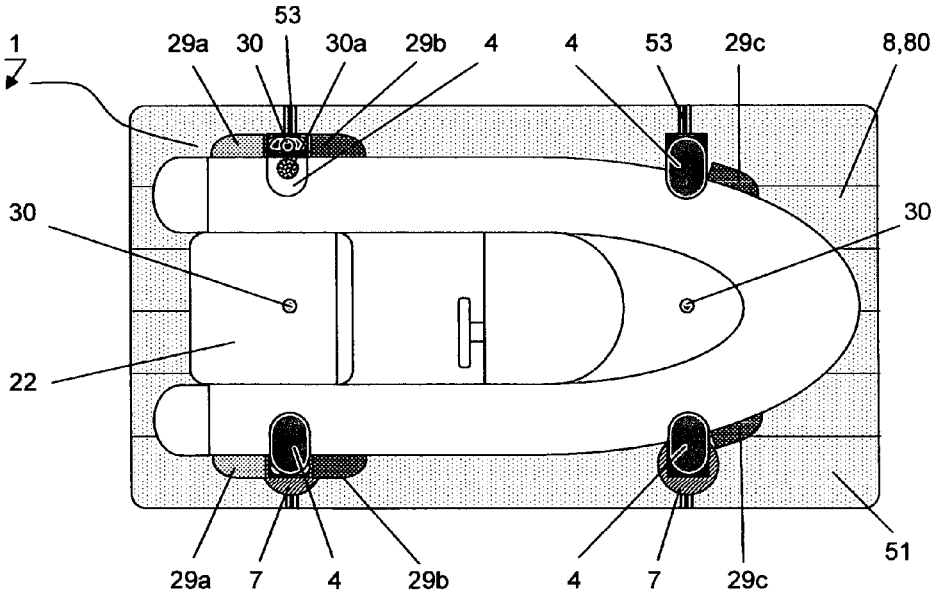

FIG. 2 shows a schematic overhead view of the tender pick up 1 with the four tiltable retainers 4 and the docking mean 29*a*,29*b* fixed on the tender 22, which completely encompass the retainer 4 on the transom- and bow side, for example no docking mean 29 needs to be fixed, as the front retainer 4 stops and centers the tender 22 and on the transom side, the tender 22 is prevented from slipping backwards by the docking mean 29*a*,29*b*.

Or on the transom side there is only the docking mean 29*a* and the docking mean 29*c* on the bow side of the tender 22, so that the tender 22 can be held fast in this way. As shown the retainers 4 can either be straight or curved. The curved retainers 4 hold down the tender 22 on the chock 2. By means of controller 19 the opening and closing time, as well as the opening angle or opening levels of retainers 4, can be set, so that the tender 22 for example is held at the back whereas at the front it is completely open and when opening the rear retainers 4, subsequently the tender 22 elegantly glides out forwards, or when picking up the tender 22, the front retainers 4 are already closed whilst the rear retainers 4 give free access. Sensors 30 on the underside of the tender 22 respectively at the appropriate places on the tender pick up 1, indicate to the controller 19, that the tender 22 is placed in the right position and that the retainers 4 can be closed. It is conceivable that such sensors 30, even photoelectric sensors can be integrated in the retainers 4 and on the hull surface of the tender 22 add-on sensors 30*a* are fixed, as for example passive reflectors or metal elements so that, given that the tender 22 is in the correct position in relation to the retainer 4, an appropriate signal can be emitted to the appropriate sensor 30, so that the retainer 4 will be closed.

The tender pick up 1 can be attached firmly to the drop down platform 80 or fixed on the swiveling arm 7, or to one of the detachable decks 51 on the platform 80, or to one of the sledges—not shown here—with rail holding 53 which are on the platform 80 or deck 51, or on the single steps of the stair 8, so when lowering or and extending the tender pick up 1, the tender 22 can be launched into the water or brought back on board.

Figure 3:
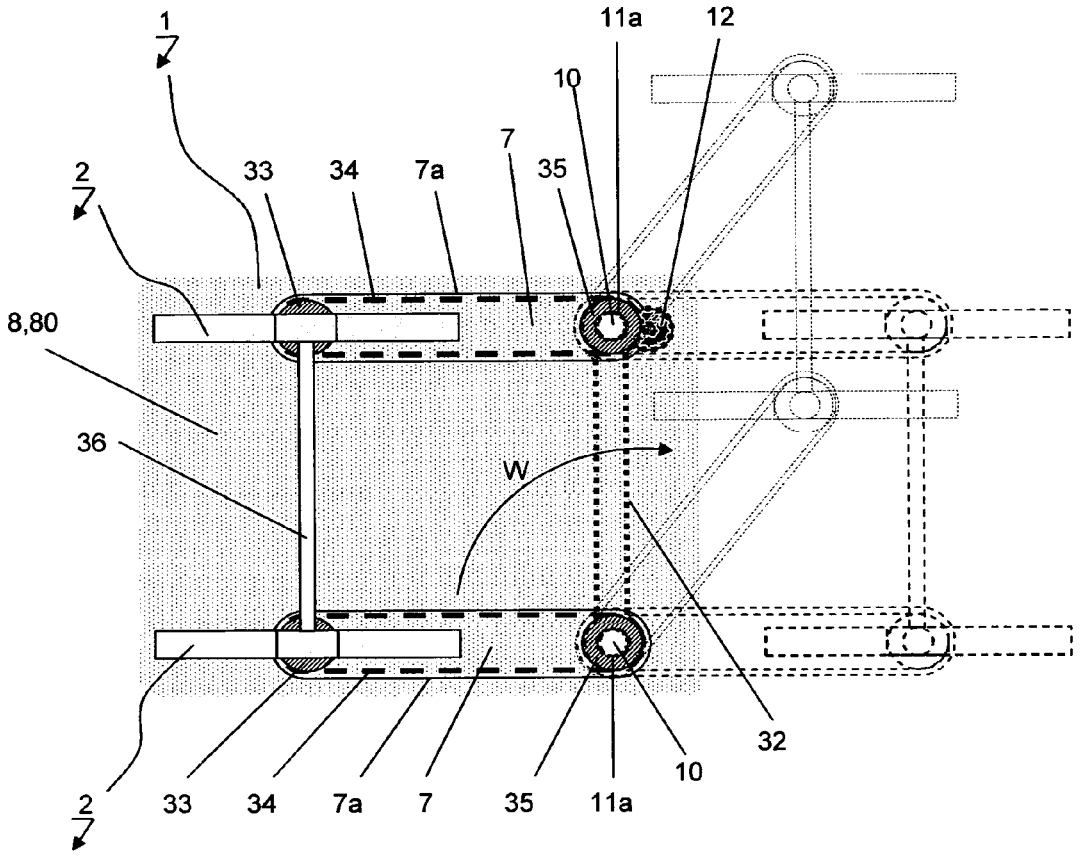

FIG. 3 shows a schematic overhead view of a tender pick up 1 with the horizontal swiveling arm 7 which are mounted on the stair 8. The swiveling arms 7 are moved into the arrow position W by the swiveling motor 12 by means of the driving belt 32 before lowering stair 8. The driving belt 32 synchronizes both of the swiveling arms 7 and interlocks to the gear 11*a* which is connected to the swiveling body 7*a* and the turning axis 10. In each swiveling body 7*a* is a tooth belt plate 33, which on the one hand incorporates the swiveling belt 34 and on the other hand the chock 2, which is only rudimental shown here. In one of the stair steps 8*a*, preferably in the last, the rigid tooth belt plate 35 is fixed, too, which has a hole in which the turning axis 10 is inserted and so when swiveling the swiveling arm 7, the swiveling belt 34 turns around the rigid tooth belt plate 35 thereby the chock 2 keeps its alignment.

In addition a connecting bar 36 can be fixed between both of the swiveling arms 7 so that the system has increased stability. Of course, as an alternative to the driving belt 32 or swiveling belt 34 the function can be guaranteed by rods or additional gear wheels as well by swiveling motors 12 communicating in conjunction with each other or such like.

In the case of a basic drop down platform 80, the swiveling arms 7 are of no advantage and therefore, if there is sufficient space available, then the chocks 2 are fixed directly onto the appropriate platform 80.

Figure 4:
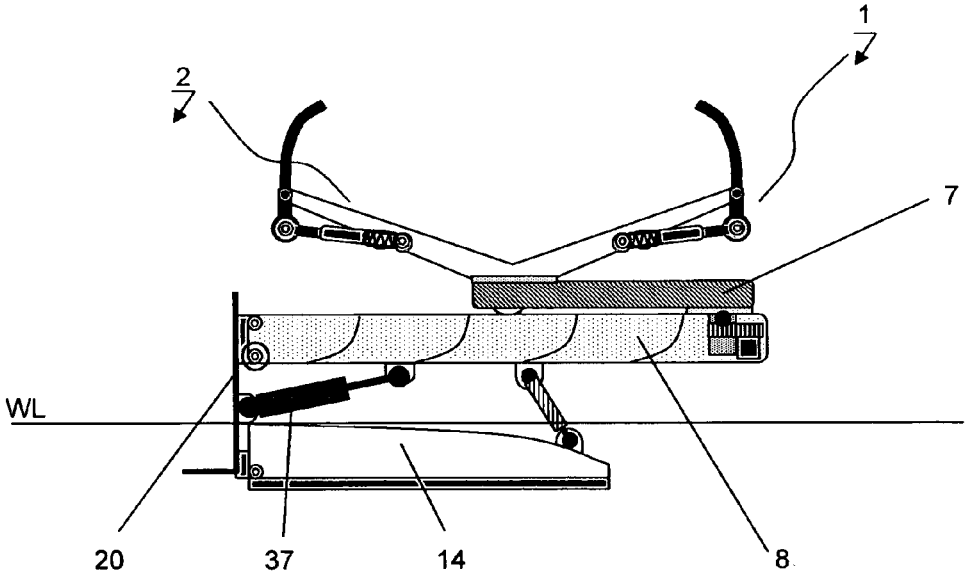

FIG. 4 shows a schematic side view of a tender pick up 1 consisting of at least a chock 2 with swiveling arm 7 which are fixed to the stair 8 and beneath is a lifting body 14. It is evident that the tender pick up 1 has on the left and right side a chock 2 with swiveling arm 7 as well as on the left and right side a lifting body 14 is positioned under the stair 8. The lifting bodies 14 have preferably a height which reaches at maximum to the waterline WL, so that when the stair 8 is lowered no addition lifting force occurs. The static lifting force should be chosen in a way so that the additional weight of a stair 8 and tender pick up 1 is compensated by its lifting force. Therefore, it can be ensured that, if the lifting cylinder—not shown here—has a breakdown, the stair 8 and the tender pick up 1 is lifted up according to the Archimedean principle and the stairs 8 can be fixed in the upper position by mean. Nevertheless it could be that the volume is insufficient to raise the whole system, therefore gas springs 37 are provided to take over such lifting task. As a rule, the lifting cylinder pushes the stair 8 with its tender pick up 1 in the direction of the waterline WL and that gravity does not take over the lowering.

Figure 5:
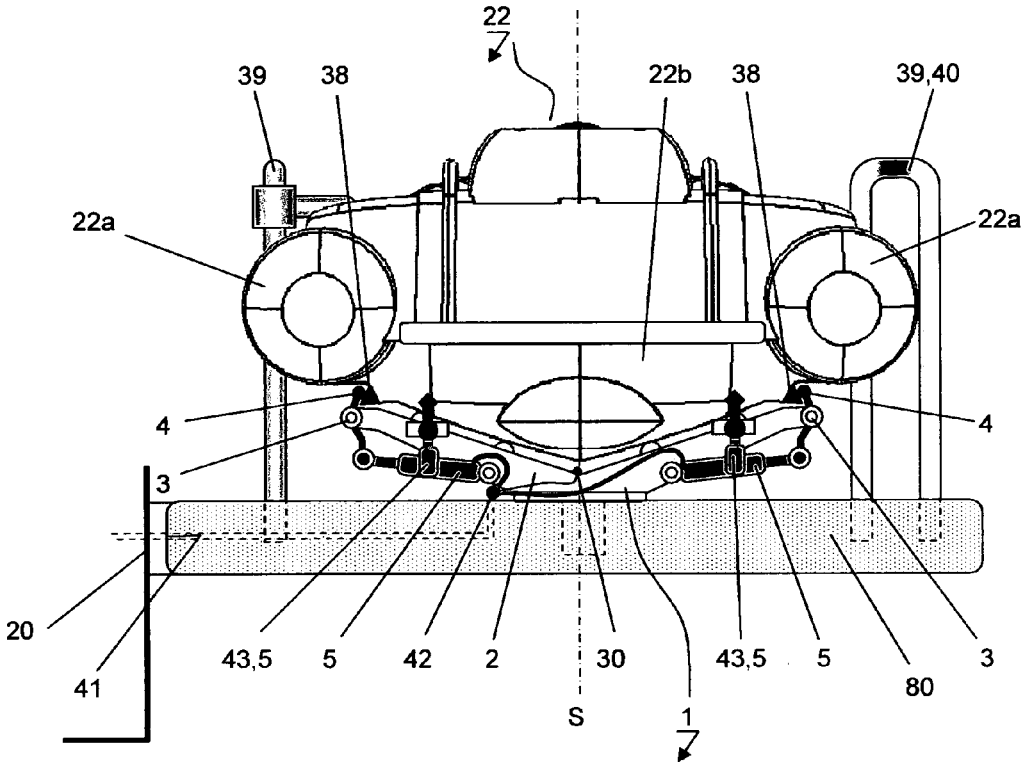

FIG. 5 shows a schematic side view of a tender pick up 1 with a tiltable retainer 4 which is moved by the cylinder 5 over the pivot mechanism 3 and clamps on the fins 38 mounted on the solid hull 22*b*. The fins 38 are formed in such a way that they position the tender 22 in the axis S with the retainer 4 and at the same time holding it down with a force so that the tender 22 cannot be lifted off of the tender pick up 1 in heavy seas. In addition the fins 38, depending on their design, can create an additional dynamic lifting force when cruising or and creating an additional driving stability. The primary positioning of the tender 22 on the platform 80 is achieved by means of fixed or removable guiding bars 39 or bracket bar 40. It needs a bracket bar 40 mounted crosswise to the driving direction of the watercraft and one guiding bar 39 in front or two guiding bars 39 in front and at least one guiding bar 39 at the back to bring the tender 22 into the right position. Both of the front guiding bars 39 or the guiding bar 39 and bracket bar 40 are positioned in such a way that the tender 22 cannot drive through and so the tender 22 is positioned transversally by the appropriate chosen clamping point at the entrance. If the tender 22 is now pressed against the bracket bar 40 or against at least one of the guiding bars 39, the tender 22 is pretty correctly in alignment with the axis S. By tilting the retainer 4 the tender is positioned centrally, clamped and locked. If the ends of the retainer 4 are slip-proof, then in this version there is no need for a docking mean 29 which could otherwise be introduced directly onto the fins 38.

Conceivable is also that the tender 22 can be held in a slip-free, locked position on the tender pick up 1 by means of rear stopping mean 43. These pivotable stopping mean 43 can also have the same components as described in the aforegoing version in order to keep the tender 22 safely fixed.

The tender pick up 1 can be plugged in and secured on the platform 80 and correspondingly released again and when not in use, stowed. On the platform 80 an appropriate wiring 41 has been installed and is equipped with waterproof, boltable plug-in connectors 42, so that the cylinder 5 embedded in the chock 2 as well as possible inductive sensors 30 are uncoupled instantly.

Figure 6:
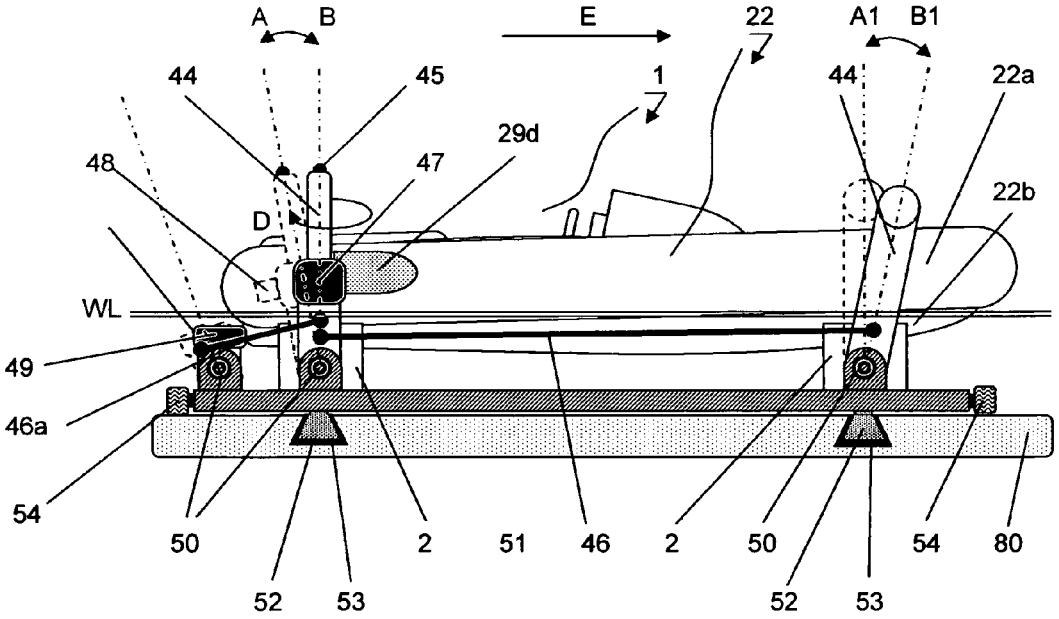

FIG. 6 shows a schematic sideview of a tender pick up 1 with a hinged, manually forward tilting holding mean 44, which is operated mechanically. The manual holding mean 44 can be swiveled by using the unlocking mean 45 which is connected to an additional manual holding mean 44 by means of a connector mean 46 and a transversal connector 46*a*, so that the opposite and the front manual holding mean 44, which may even be curved, are operated simultaneously according to arrow A-B, A'-B'.

A turning knob 47 with a cam 48 is fixed on the manual holding mean 44 so that when swiveling the manual holding mean 44, the turning knob 47, with an integrated gear wheel set in the form of an angular gear or a crown wheel design, turns around the vertical axis of the manual holding mean 44, according to arrow D and pressing against a docking mean 29*d* fixed to the tender 22.

This prevents the tender 22 from slipping backwards out of the manual holding mean 44, i.e. against arrow E. In addition there is material of the docking mean 29*d* protruding above cam 48 so that the tender 22 is prevented from moving itself upwards as well.

The manual holding mean 44, by means of an additional connector mean 46, can be connected to a mechanical stopping mean 49, fixed behind the tender 22, in case the tender 22 does not have a docking mean 29*d* and in this way the tender 22 can be fixed to the tender pick up 1.

The manual holding mean 44 can be fixed to the chock 2 or on the platform 80 or on a sledge 81 by means of the pivot bearing 50. The function of the sledge 81 is to move the tender 22 on the stair 8 or platform 80, for example for garage or additional shifting applications. The sledge 81 can be constructed as deck 51 in order to lift the chock 2 and if required may also have incorporated a mechanical stopping mean 49 or and guiding bars 39 or and bracket bars 40. Otherwise the sledge 81 is a cradle which lifts the front and back chocks 2 and has a rail underneath which is linked to a rail holding 53, which is fixed onto the single stair steps of the stair 8 or the drop down platform 80. The sledge 81 can also have a wheel set 54 which supports the sledge 81 when shifting or when releasing it from the watercraft. The sledge 81 can be further used on land.

Of course the invention is not only applicable on shown and described examples.

DRAWING LIST

1 tender pick up
2 chock
3 pivot mechanism
4 retainer
5 cylinder
6 spring
7 swiveling arm
7*a* swiveling body
8 stair
8*a* stair steps
80 drop down platform
81 sledge
9*a* upper swiveling bearing
9*b* lower swiveling bearing
10 turning axis
11 gear set
11*a* gear
12 swiveling motor
13 lifting body bearing
14 lifting body
14*a* step
15 connector
16 wing
17 bearing set
18 travel sensor
19 controller
20 transom
21 support
22 tender
22*a* hose
22*b* solid hull
23 position sensor
24 step compensator
25 plate
26 trim cylinder
27 trim hinge
28 bearing pole
29*a,b,c,d* docking mean
30 inductive sensor
30*a* add-on sensor
31 lock
32 driving belt
33 tooth belt plate
34 swiveling belt
35 rigid tooth belt plate
36 connecting bar
37 gas spring
38 fin
39 guiding bar
40 bracket bar
41 wiring
42 plug-in connector
43 stopping mean
44 manual holding mean
45 unlocking mean
46 connector mean
46*a* transversal connector
47 turning knob
48 cam
49 stopping mean
50 pivot bearing
51 deck
52 rail
53 rail holding
54 wheel set
H stroke
W swiveling angle
A side stroke
WL waterline
S axis
HS stroke level
E entrance

The invention claimed is:

1. A tender pick-up for a watercraft, the tender pick-up comprising: a chock with two sides that are collectively configured to hold a tender when the tender is placed on top of the chock; a retainer formed on each side of the chock; and a pivot mechanism formed on each side of the chock, wherein the retainers move about the chock via the pivot mechanisms, and wherein the retainers move about the pivot mechanisms between a first position in which the retainers contact the tender when the tender is placed on top of the chock and a second position in which the retainers are spaced away from the tender when the tender is placed on top of the chock.

2. The tender pick-up according to claim 1, further comprising a cylinder that moves the retainers between the first position and the second position.

3. The tender pick-up according to claim 2, wherein each of the retainers can rotate about the pivot mechanisms using the cylinder.

4. The tender pick-up according to claim 2, further comprising a stopping device attached to the cylinder that contacts the tender when the tender is placed on top of the chock.

5. The tender pick-up according to claim 1, wherein each of the retainers can manually rotate about the pivot mechanisms.

6. The tender pick-up according to claim 1, further comprising a spring that is attached to each of the retainers so that each of the retainers applies a force against the tender when the tender is placed on top of the chock.

7. The tender pick-up according to claim 1, wherein each tender has a curved shape.

8. The tender pick-up according to claim 1, wherein each tender has a linear shape.

9. The tender pick-up according to claim 1, wherein each of the retainers is configured to hold down an upper side of the tender when the tender is placed on top of the chock.

10. The tender pick-up according to claim 1, wherein each of the retainers is configured to clamp on fins of the tender when the tender is placed on top of the chock.

11. The tender pick-up according to claim 1, wherein each of the retainers can rotate.

12. The tender pick-up according to claim 1, wherein each of the retainers can synchronously be opened and closed.

* * * * *